US010849383B2

(12) United States Patent
Sciortino

(10) Patent No.: US 10,849,383 B2
(45) Date of Patent: Dec. 1, 2020

(54) WEARABLE IMPACT PROTECTION AND FORCE CHANNELING DEVICE

(71) Applicant: Stephen Sciortino, Warrensburg, MO (US)

(72) Inventor: Stephen Sciortino, Warrensburg, MO (US)

( * ) Notice: Subject to any disclaimer, the term of this patent is extended or adjusted under 35 U.S.C. 154(b) by 541 days.

(21) Appl. No.: 15/463,457

(22) Filed: Mar. 20, 2017

(65) Prior Publication Data

US 2017/0266536 A1 Sep. 21, 2017

Related U.S. Application Data

(60) Provisional application No. 62/310,435, filed on Mar. 18, 2016.

(51) Int. Cl.
*A42B 3/04* (2006.01)
*A41D 13/015* (2006.01)
*A41D 13/05* (2006.01)

(52) U.S. Cl.
CPC ..... *A42B 3/0473* (2013.01); *A41D 13/0155* (2013.01); *A41D 13/0512* (2013.01); *A41D 13/0518* (2013.01)

(58) Field of Classification Search
CPC ..... A42B 3/0473; A41D 13/0155; A41D 13/0512; A41D 13/0518
USPC ..... 2/459
See application file for complete search history.

(56) References Cited

U.S. PATENT DOCUMENTS 2,939,148 A * 6/1960 Hart ..... B64D 10/00 2/2.13
3,293,659 A * 12/1966 Shepard ..... A42B 3/28 128/201.15
3,667,459 A * 6/1972 Durney ..... A62B 18/04 128/201.15
3,879,761 A * 4/1975 Bothwell ..... A42B 3/0473 2/11
4,274,161 A * 6/1981 Littler ..... A42B 3/0486 2/413
4,386,277 A * 5/1983 Forshee ..... G21F 3/02 2/9
4,453,271 A * 6/1984 Donzis ..... A41D 13/0153 2/2.5
4,825,476 A * 5/1989 Andrews ..... A42B 3/0473 2/421
4,999,855 A * 3/1991 Brown ..... A42B 3/0473 2/421
5,007,893 A * 4/1991 Row ..... A62B 17/008 128/201.29
5,287,562 A * 2/1994 Rush, III ..... A41D 13/018 2/413
5,295,271 A * 3/1994 Butterfield ..... A42B 3/0473 2/410
5,313,670 A * 5/1994 Archer, III ..... A41D 13/018 2/410
5,318,018 A * 6/1994 Puma ..... A62B 17/008 128/202.11

(Continued)

*Primary Examiner* — Anne M Kozak
(74) *Attorney, Agent, or Firm* — Polsinelli PC; Adam C. Rehm

(57) ABSTRACT

A wearable impact protection and force channeling device operable to transfer force received via impact from a head of the user to a body of the user, thereby utilizing an entire mass of the user to lessen rapid momentum change of the head.

18 Claims, 8 Drawing Sheets

(56) References Cited

U.S. PATENT DOCUMENTS 5,353,437 A * 10/1994 Field ..... A41D 13/0153 2/421
5,402,535 A * 4/1995 Green ..... A41D 13/018 128/DIG. 23
5,930,843 A * 8/1999 Kelly ..... A41D 13/0512 2/421
6,067,665 A * 5/2000 DePalma ..... A41D 13/0512 2/44
6,296,204 B1 * 10/2001 Lewis ..... A42B 3/0473 2/413
6,385,781 B1 * 5/2002 Rose ..... A42B 3/00 2/421
6,434,756 B1 * 8/2002 Hoop ..... A41D 13/0512 2/425
6,874,170 B1 * 4/2005 Aaron ..... A41D 13/0512 2/468
7,543,846 B2 * 6/2009 Makabe ..... A41D 13/018 280/730.1
8,402,568 B2 * 3/2013 Alstin ..... A41D 13/018 2/413
8,464,366 B2 * 6/2013 Carron ..... A62B 17/005 128/201.28
9,027,170 B2 * 5/2015 Dainese ..... A41D 13/018 2/455
9,462,841 B1 * 10/2016 Popejoy ..... A41D 13/0512
9,554,604 B2 * 1/2017 Rippert ..... A62B 17/005
9,648,914 B2 * 5/2017 Duncan ..... A41D 13/018
9,861,152 B1 * 1/2018 Rumfelt ..... A42B 3/0473
10,004,925 B2 * 6/2018 Tuffery ..... A62B 17/006
2004/0128744 A1 * 7/2004 Cleveland ..... A41D 13/0512 2/422
2009/0126085 A1 * 5/2009 Gale ..... A42B 3/0473 2/415
2009/0158509 A1 * 6/2009 Ghajar ..... A42B 3/046 2/422
2010/0263110 A1 * 10/2010 Berry ..... A41D 13/0512 2/459
2011/0004980 A1 * 1/2011 Leatt ..... A42B 3/0473 2/424
2012/0167289 A1 * 7/2012 Kim ..... A41D 13/0512 2/461
2012/0192340 A1 * 8/2012 Minson ..... A42B 3/0473 2/468
2012/0278980 A1 * 11/2012 Chuback ..... A41D 13/0512 2/461
2013/0031706 A1 * 2/2013 Cooksey ..... A42B 3/0473 2/459
2013/0185854 A1 * 7/2013 Bonomelli ..... A42B 3/0473 2/468
2014/0020161 A1 * 1/2014 Mason ..... A41D 13/015 2/462
2014/0109304 A1 * 4/2014 Kwan ..... A41D 13/015 2/461
2014/0237707 A1 * 8/2014 Lane ..... A42B 3/125 2/414
2015/0223543 A1 * 8/2015 Hernandez ..... A42B 3/0473 2/459
2016/0037850 A1 * 2/2016 Benson ..... A42B 3/0473 2/411
2016/0338440 A1 * 11/2016 Popejoy ..... A42B 3/0473
2017/0065016 A1 * 3/2017 Chuback ..... A42B 3/0473
2017/0251742 A1 * 9/2017 Partlo ..... A42B 3/0473
2017/0290386 A1 * 10/2017 Murray ..... A42B 3/0473
2017/0325521 A1 * 11/2017 Li ..... A41D 13/018
2017/0367427 A1 * 12/2017 Meade ..... A42B 3/0473
2018/0147474 A1 * 5/2018 Hodge ..... A63B 71/1291
2018/0360153 A1 * 12/2018 Popejoy ..... A63B 71/081

* cited by examiner

WEARABLE IMPACT PROTECTION AND FORCE CHANNELING DEVICE

CROSS-REFERENCE TO RELATED APPLICATION

This Patent Application claims priority to U.S. Patent Application Ser. No. 62/310,435 titled Wearable Impact Protection and Force Channeling Device filed Mar. 18, 2016, the entire contents of which is herein incorporated by reference in its entirety.

BACKGROUND

1. Field

The present inventive concept relates to a wearable safety device configured to protect a user from brain and neck trauma by preventing direct impact to the user's head. More particularly, the present inventive concept provides a wearable impact protection and force channeling device operable to transfer force received via impact from a head of the user to a body of the user, thereby utilizing an entire mass of the user to lessen rapid momentum change of the head.

2. Description of Related Art

The brain has natural shock absorbers in the form of three layers of meninges membranes and cerebrospinal fluid, but these can be overwhelmed when subjected to excessive force. Brain-skull contact is most likely under two conditions, i.e., first at an initial impact, e.g., from being struck, when the skull rapidly gains momentum and is driven into the brain due to its inertia lag, or second when the skull comes suddenly to rest, e.g., from striking the ground, but the momentum of the brain causes it to continue its movement and strike the skull. Thus, to limit the momentum/inertia imbalance that causes brain-skull contact, an acceleration/deceleration inhibitor for the head must be integrated into any head protection device.

Conventional helmets are worn to reduce impact induced head injuries in various industries such as sports, e.g., football, lacrosse, BMX, NASCAR, rally racing and construction. Conventional helmets are operable to be secured to a user's head in an attempt to reduce direct impact damage.

A problem with such conventional helmets is that, among other things, such allow impact forces to be concentrated on the head of the user, thereby creating sudden acceleration and/or deceleration of the head of the user. Such sudden acceleration and/or deceleration can result in a concussion, which occurs when the user's brain impacts an interior of the user's skull. Further, such sudden acceleration and/or deceleration can result in impact induced movement of the head independent of the body, which creates stress concentrations along the neck and spinal cord. Such stress concentrations can result in paralysis.

When conventional helmets are used in sports, such allow the kinetic force of an impacting opposing player, which consisting of one half of their entire mass times their velocity squared, to be concentrated initially at the moment of impact onto the much lesser head mass of the impactee helmet user. The overall ratio of the total mass of the opposing player vs. the helmet user's head mass usually exceeds 10:1 in normally proportioned individuals and may exceed 20:1 in professional athletes who are larger and more muscular. Thus, by the limitation of their design, conventional helmets are required to initially resist an order of magnitude imbalance between the impacting force and the resisting force caused by the disproportion of the total mass of the impacting player and the limited mass of the head of the impactee. This force imbalance results in excessive acceleration of the helmet user's head imparted by the momentum of the opposing player, which can result in concussion if the sudden acceleration or deceleration causes their brain to strike the inside of the skull. Additionally, even though conventional helmets may prevent direct damage to the user's skull, they do nothing to resist force concentration to the neck of the impactee, which may also result in paralyzing injury.

Accordingly, there is a need for a device that does not suffer from the limitations of conventional helmets, is operable to protect a user's neck as well as a user's head, is operable to channel forces received from both acceleration and deceleration away from a user's neck and head, has a simple design that is easy to use, and is economical to manufacture.

SUMMARY

The following brief description is provided to indicate the nature of the subject matter disclosed herein. While certain aspects of the present inventive concept are described below, the summary is not intended to limit the scope of the present inventive concept. Embodiments of the present inventive concept provide an inventive concept for a wearable impact protection and force channeling device operable to transfer force received via impact from a head of a user to a body of the user, thereby utilizing an entire mass of the user to lessen rapid momentum change of the head. The present inventive concept does not suffer from and remedies the deficiencies of conventional devices such as those previously set forth herein.

Instead of a helmet being fastened to the head of the user as a protective shell while still allowing direct impact to the helmet/head and subsequent force concentrations to the neck, the present inventive concept provides a device that encases both the head and neck via a protective dome that is fastened to the body of the user, thereby preventing direct contact with the head and neck, and channeling or transferring the force of the impact to the body of the user. In this manner, the device of the present inventive concept allows the entire mass of the user to resist the impact force, thereby reducing acceleration, as opposed to conventional helmets that allow an impact to be concentrated on just the user's head mass.

It is an object of the present inventive concept to channel or transfer impact force to the body of the user instead of the direct contact with the head that conventional helmet technology allows.

It is an object of the present inventive concept to protect the neck, thereby reducing the chance of spinal injuries.

It is an object of the present inventive concept to provide a protective device that can be used in various applications including, but not limited to sports protective gear, e.g., football in secondary school, college and NFL, and hockey, lacrosse, BMX, NASCAR and/or the like.

The device of the present inventive concept generally includes three components, i.e., a protective transparent dome that encapsulates a head of a user, a body harness that fastens to the body of the user and is operable to securely support the dome, and an inflatable restraint system to limit head and neck movement, which serves a dual purpose of dampening head acceleration and preventing impact of the user's head with the inside of the dome and collar. When the first component is affixed to the second component, the combination prevents direct impact contact with the neck and head, and transfers impact forces to the body of the user.

Depending upon application of the device of the present inventive concept, the dome may be made of either a completely transparent material or a combination of one or more transparent and opaque materials.

The dome is semi-spherical in shape, the surface of which is treated with an anti-fogging coating supplemented with anti-fogging ventilation slits near the crown, and either a threaded slatted flange or a slatted horizontal flange at its base for insertion into the mounting collar of the body harness. If the optical characteristics of the dome material adversely affect the performance of the user, the dome may be optionally equipped with an open viewport.

The body harness consists of a shell with front and back plates that has its inside surface lined with compression pads to facilitate a tight fit when secured, that is strapped tight to the body of the user and to which existing football shoulder pad technology can be affixed, a mounting collar with a slotted receiver ring that allows the insertion and rotation of the corresponding slatted flange of the dome, a front opening in the mounting collar for access to the user's mouth, a locking mechanism consisting of a spring tensioned pin that secures the dome once it is inserted into the receiver ring, a loop on the spring tensioned locking pin to enable the attachment of a mouth guard and to facilitate the manual depression of the pin, a restraint system consisting of an inflatable bladder encased within multi-densities of compression foam to limit head movement (to resist head impact with the dome and prevent neck injury), and a recessed valve to allow for the inflation of the restraint system. A compression ring option may be installed in the collar to allow yielding of the dome-collar assembly upon impact, so as to lessen the chance of injury to opposing players when they are struck by the assembly.

The aforementioned may be achieved in one aspect of the present disclosure by providing a protective device operable to transfer force from a first portion of a user to a second portion of a user. The device may include a first component operable to encapsulate a first portion of a user. The first component may be entirely, mostly, or partially transparent to permit the user to view through the first component, thereby providing a user with visibility through the device. The device may also include a second component operable to secure the first component to a second portion of the user. The device may also include a third component secured to the second component. The third component may be operable to limit movement of the user relative to the second component.

The first component may be entirely or partially curved or dome-shaped. The second component may include a harness and is able to function as a body harness. The third component may be entirely or partially inflatable, e.g., via introduction of air into the third component via a valve or the like.

The device may further include a circulation system operable to (i) permit gas to enter and/or exit the first component, and/or (ii) maintain a degree of visibility through the portion of the first component. The circulation system may include at least one vent in and/or extending entirely through the first component.

The device may further include at least one interior compression pad having an inflatable bladder on the second component and/or the third component. The device may further include an access port on the second component operable to allow a user access to the third component to inflate the third component. The device may further include at least one inflation valve accessible via the access port on the second component. The at least one inflation valve may be in communication with the inflatable bladder. The inflation valve may be recessed relative to an outermost surface of the second component.

The device may further include at least one front opening in the second component. The device may further include at least one mounting collar on the second component. The at least one mounting collar may be resiliently secured to the second component so that the at least one mounting collar is biased away from the second component, e.g., via one or more resilient elements or springs.

The device may further include at least one locking mechanism operable to secure the first component to the second component. The device may further include at least one release mechanism operable to enable detachment of the first component from the second component when actuated. The device may further include a mounting loop operable to secure a mouth guard to the device.

The device may further include at least one fastener on the second component. The device may further include at least one shoulder pad and/or chest plate on the second component. The first component may be operable to be secured to the second component by insertion of the first component into the second component. The first portion of the user may be a head of the user. The second portion of the user may be a body of the user.

The foregoing and other objects are intended to be illustrative of the present inventive concept and are not meant in a limiting sense. Many possible embodiments of the present inventive concept may be made and will be readily evident upon a study of the following specification and accompanying drawings comprising a part thereof. Various features and subcombinations of the present inventive concept may be employed without reference to other features and subcombinations. Other objects and advantages of this present inventive concept will become apparent from the following description taken in connection with the accompanying drawings, which set forth by way of illustration and example, an embodiment of this present inventive concept and various features thereof.

BRIEF DESCRIPTION OF DRAWINGS

A preferred embodiment of the present inventive concept, illustrative of the best mode in which the applicant has contemplated applying the principles, is set forth in the following description and is shown in the drawings.

Figure 1:
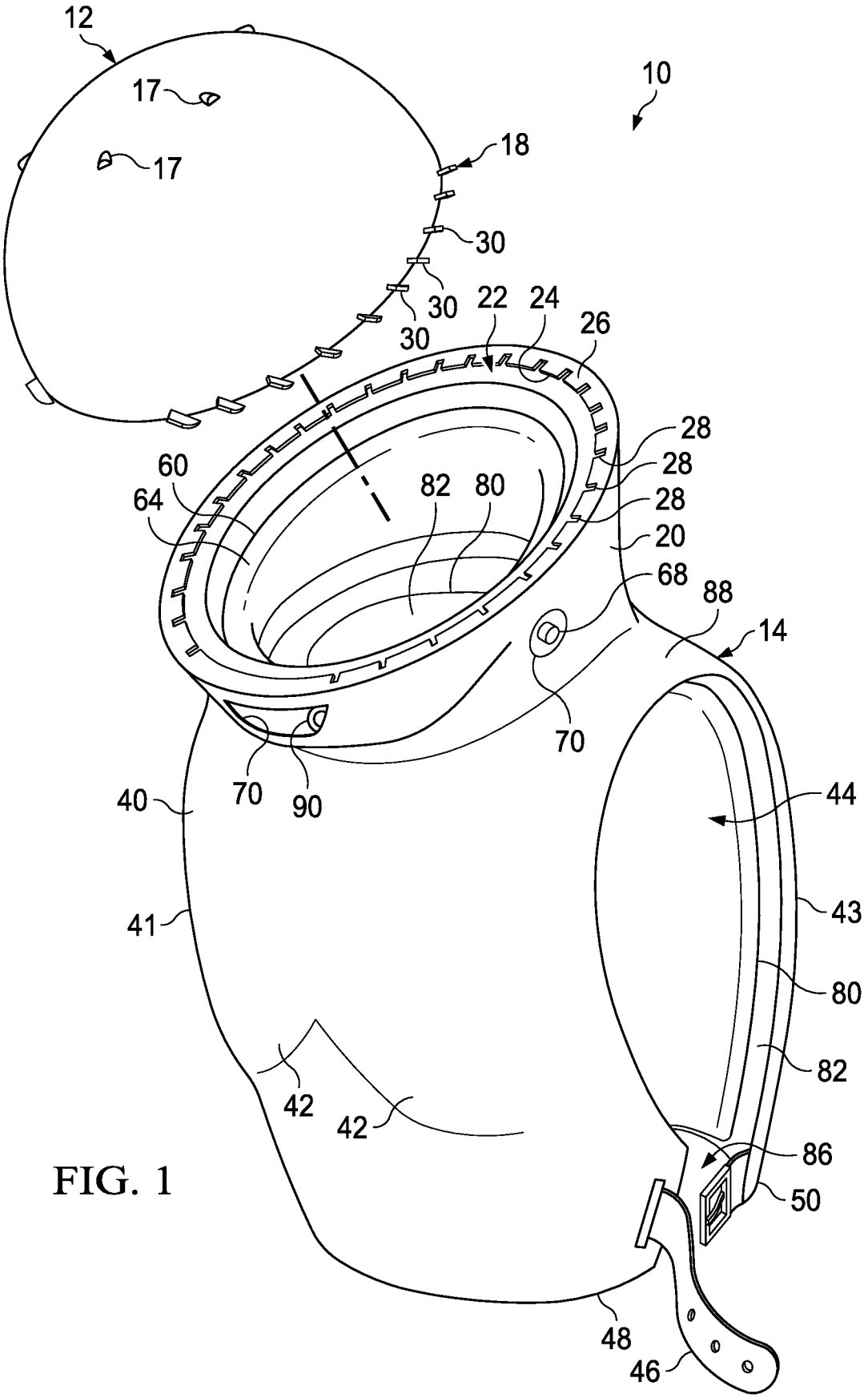
FIG. 1 is a top, left, front perspective view of a wearable impact protection and force channeling device of the present inventive concept.
Figure 2:
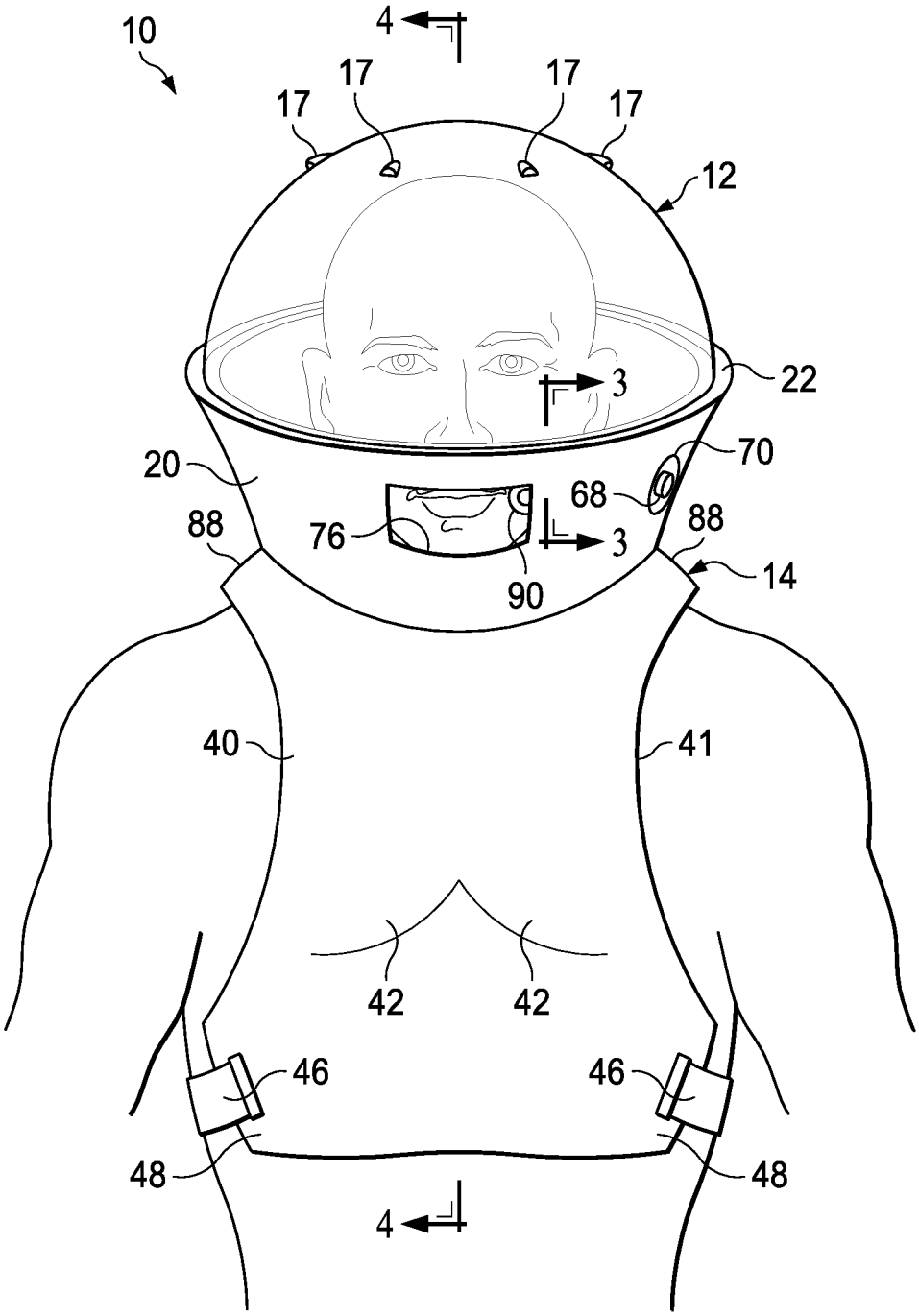
FIG. 2 is an elevated front view of the device of FIG. 1 fitted on a user.

The drawings do not limit the present inventive concept to the specific embodiments disclosed and described herein. The drawings are not necessarily to scale, emphasis instead being placed on clearly illustrating principles of certain embodiments of the present inventive concept.

DETAILED DESCRIPTION

The following detailed description references the accompanying drawings that illustrate various embodiments of the present inventive concept. The illustrations and description are intended to describe aspects and embodiments of the present inventive concept in sufficient detail to enable those skilled in the art to practice the present inventive concept. Other components can be utilized and changes can be made without departing from the scope of the present inventive concept. The following detailed description is, therefore, not to be taken in a limiting sense. The scope of the present inventive concept is defined only by the appended claims, along with the full scope of equivalents to which such claims are entitled.

I. Terminology

In the description, terminology is used to describe features of the present inventive concept. For example, references to terms "one embodiment," "an embodiment," "the embodiment," or "embodiments" mean that the feature or features being referred to are included in at least one aspect of the present inventive concept. Separate references to terms "one embodiment," "an embodiment," "the embodiment," or "embodiments" in this description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure as described herein are not essential for its practice.

The term "user" is generally used synonymously herein to represent a user of the device. For purposes herein, the user may be an athlete or a construction worker.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As the present inventive concept is susceptible to embodiments of many different forms, it is intended that the present disclosure be considered as an example of the principles of the present inventive concept and not intended to limit the present inventive concept to the specific embodiments shown and described.

II. General Architecture

Turning to the drawings and particularly FIGS. 1-6C, a wearable impact protection and force channeling device 10 is illustrated. The device 10 includes a first component 12 operable to be detachably secured to a second component 14. In the exemplary embodiment, the first component 12 is a protective semi-spherical, dome-shaped element operable to be received over and encompass a user's head. It is foreseen that the first component 12 can be variably sized to accommodate heads of different sizes and may not be perfectly semi-spherical, but may have an oblong shape or be shaped as an elliptical sphere without deviating from the scope of the present inventive concept. For instance, an average head is approximately 9 inches long, 6 inches wide, and 9 inches tall. In the exemplary embodiment, the first component 12 is sized and shaped to provide at least 3 inches of clearance between an average-sized head and an inner surface of the first component 12, thus is approximately 15 inches long, 12 inches wide, and 8 inches tall, given a portion of the second portion encloses the head.

The first component 12 includes a viewing area 16 made of a transparent material operable to allow the user to see through the first component 12. The viewing area 16 is sized and shaped to allow the user of the device 10 to have a full viewing range so that the device 10 does not block any portion of a user's field of vision including peripheral vision. In the exemplary embodiment, the first component 12 is entirely made of the transparent material such as polycarbonate or other similar high-strength impact-resistant material.

The device 10 of the present inventive concept includes one or more of the following features to prevent fogging caused by, for example, the user's breath, perspiration, and/or heat. It is foreseen that a portion of the first component 12, i.e., a 16, may be provided through the first component so that the user's head is encapsulated by the device 10 except for a portion aligned with a forward view of the user. Alternatively or in addition to the viewport 16, a circulation system may be provided via a plurality of vent holes 17 in the first component 12 to prevent fogging of the first component 12. Alternatively or in addition to the viewport 16 and/or vent holes 17, an inner surface of the first component 12 may include an anti-fogging coating to prevent fogging of the first component 12.

The first and second components 12, 14 are secured together via a flange 18 formed at a base of the first component 12 and a mounting collar 20 on the second component 14. The collar 20 has an inverted conical shape with an opening at the top defined by a circumferential receiver 22 and an opening at the bottom, which is attached to a remainder portion of the second component 14. The openings permit the user to extend his/her head through the collar 20. The collar 20 is substantially made of hard impact resistant plastic, which may be opaque or color infused, with various fittings and other portions of the collar 20 made of steel. It is foreseen that the collar 20 may be made of another material such as, but not limited to, polycarbonate, carbon fiber material, or other high strength material without deviating from the scope of the present inventive concept.

In the exemplary embodiment, the mounting collar 20 is operable to receive the flange 18 within the circumferential receiver 22, which extends around an uppermost portion of the mounting collar 20. The receiver 22 includes a circumferential groove 24 formed by a circumferential lip 26 with a plurality of slots 28. The slots 28 are evenly spaced from each other about a substantial portion of the lip 26 and angled downwardly, e.g., between twenty and thirty degrees relative to a plane defined by the groove 24, and preferably at twenty-five degrees. Each of the slots 28 is sized and shaped to receive one of a plurality of extensions 30, which also extend from a circumferential surface of the flange 18 at a downward, e.g., between twenty and thirty degrees and preferably at twenty-five degrees, form a portion of the flange 18. As with the slots 28, the extensions 30 are also evenly spaced from each other about a substantial portion of the flange 18 so that each of the slots 28 are sized and shaped to be securely received in one of the slots 28.

The first component 12 may be secured to the second component 14 via a number of various engagements. In the exemplary embodiment, the first component 12 is secured to the second component 14 via (i) nesting the first component 12 into the second component 14 so that a tip of each of the extensions 30 extends into one of the slots 28 and (ii) rotating the first component 12 so each of the extensions 30 is wedged or threaded into and become seated within one of the slots 28 so that the extensions 30 are entirely housed within the slots 28. When the first component 12 is rotated, the mating of the extensions 30 and slots 28 causes the first component 12 to be drawn closer to the second component 14. In the exemplary embodiment, each of the extensions 30 are approximately 2 inches long, and the first component 12 is rotated approximately 18 degrees to cause the extensions 30 to become threaded into the slots 28. It is foreseen that the extensions 30 may be shorter or longer, e.g., be 1.75 to 2.25 inches long, and/or be variably sized without deviating from the scope of the present inventive concept. To increase friction between the slots 28 and the extensions 30, the extensions 30 are tapered and have a wedge-shape, with (i) a smaller width at a leading edge of each of the extensions 30 that is first introduced into one of the slots 28, and (ii) a larger width at a trailing edge of each of the extensions 30. In this manner, the extensions 30 engage the slots 28, upon counter-clockwise rotation of the first component, via a friction fit engagement, thereby securing the first component 12 to the second component 14. The first component 12 is removed from the second component via clockwise-rotation of the first component 12 relative to the second component 14, which causes the components 12, 14 to be pushed away from each other and the extensions 30 to be removed from the slots 28.

Figure 3:
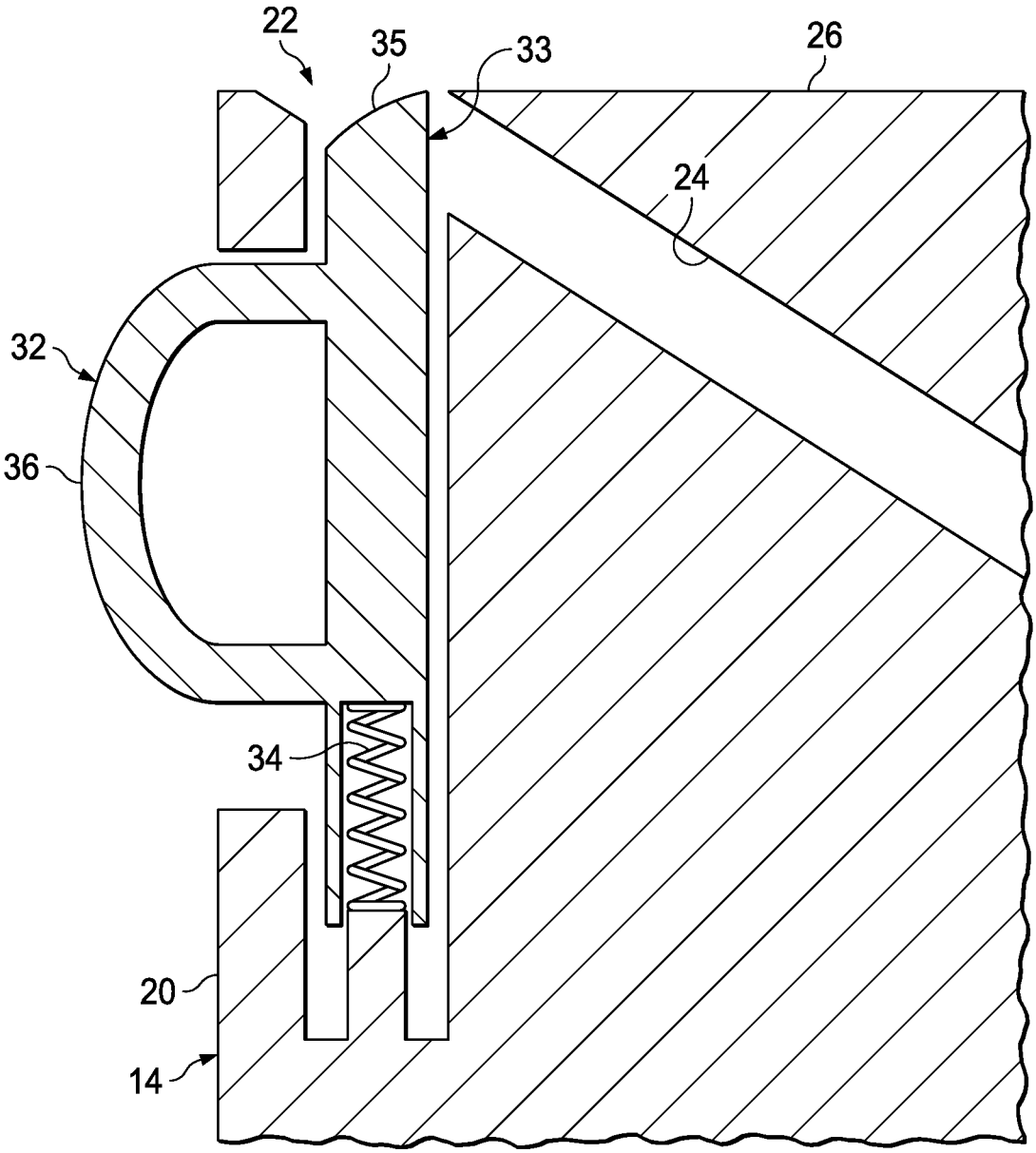
FIG. 3 is a magnified cross-sectional elevated side view of a locking mechanism of the device of FIG. 2.
Figure 4:
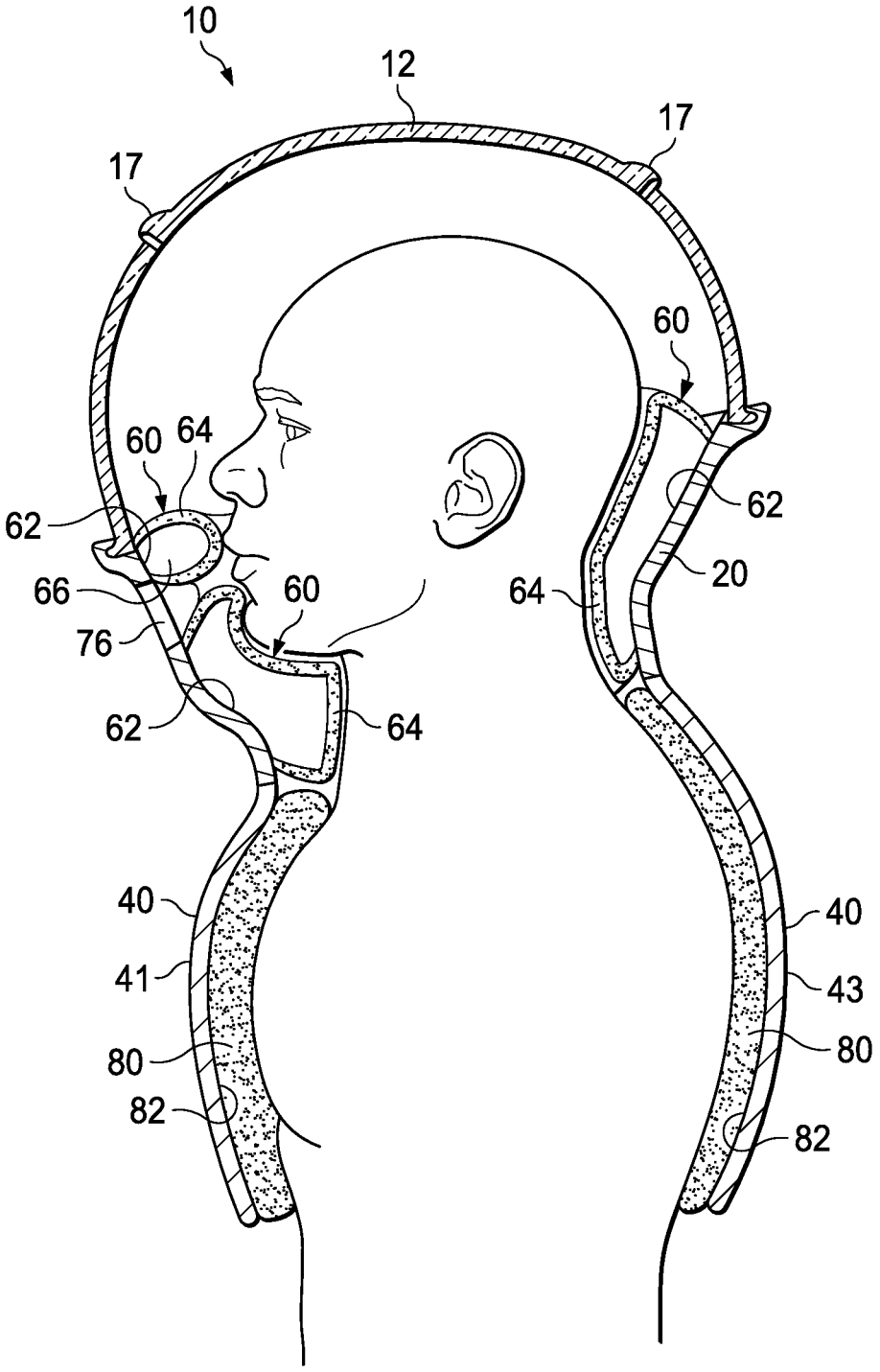
FIG. 4 is a cross-sectional elevated side view of the device of FIG. 2 fitted on the user.
Figure 5A:
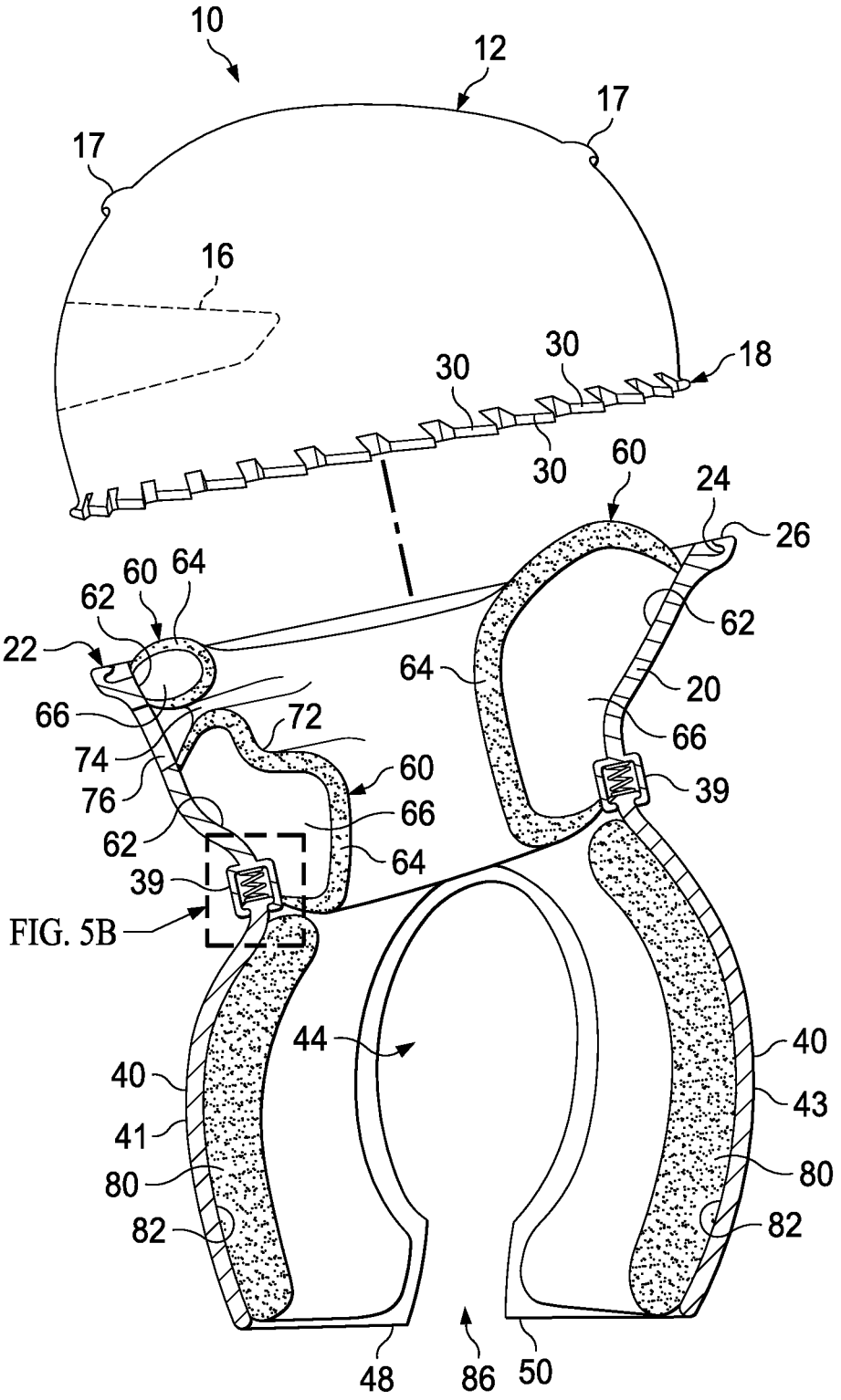
FIG. 5A is an exploded side view of the device of FIG. 1 with a first component removed from a second component and the second component in cross section.
Figure 5B:
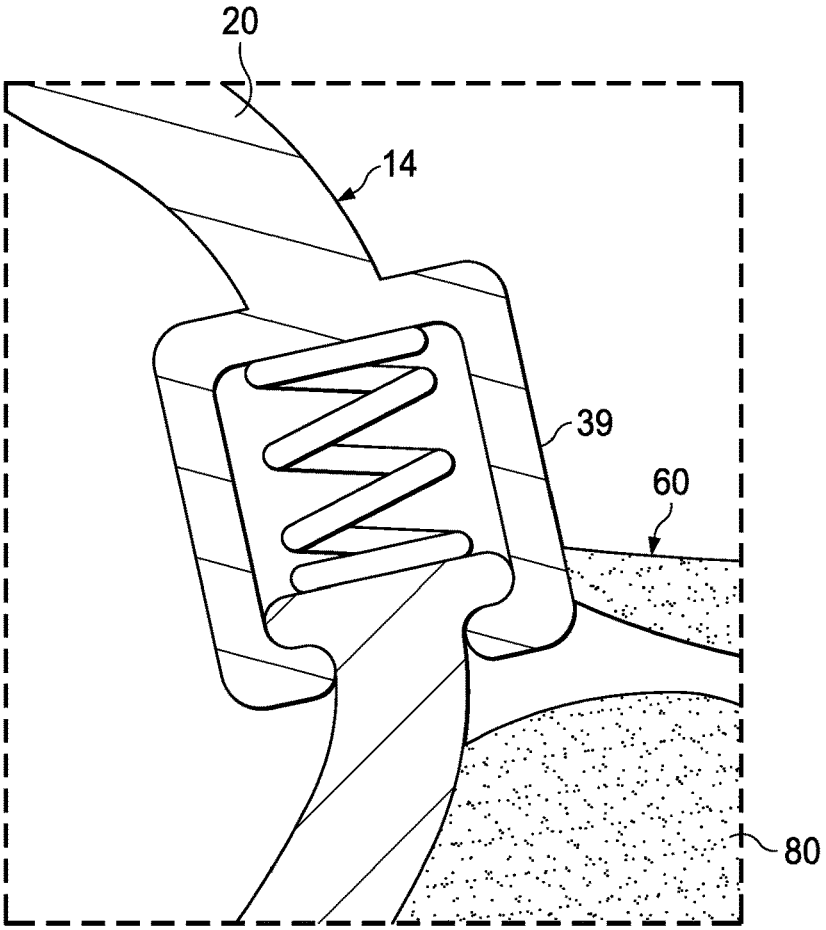
FIG. 5B is a magnified side view of a compression ring of the device of FIG. 5A.

When the first component 12 is secured to the second component 14, a locking mechanism 32 positioned at a front of the collar 20 is operable to prevent one of the extensions 30 from being removed from one of the slots 28. The locking mechanism 32 includes a locking pin 33 that is biased upwardly and toward the first component 12 to a locked position via a spring 34. The pin 33 includes a sloped surface 35. The locking mechanism 32 includes a 90 degree pivot range, and is operable to be rotatably actuated, via a handle 36, from a locked position at one end of the pivot range, i.e., with the handle 36 extending laterally relative to a user and the device 10, and an unlocked position at another end of the pivot range, i.e., with the handle 36 extending away from the user and the device 10. With the locking mechanism 32 in the unlocked position, the flange 18 is received into the groove 24, which causes one of the extensions 30 to engage and force the pin 33 downwardly from its original position as illustrated by FIG. 3, which causes the spring 34 to become compressed. Once compressed, the first component 12 is rotated as previously discussed so the extensions 30 engage the slots 28. Once engaged, the trailing edge of the one of the extensions 30 clears the pin 33, which allows the pin 33 to return to its original position due to resilient bias of the spring 34. Finally, the handle 36 is rotated 90 degrees to extend laterally relative to the user, which causes the locking mechanism 32 to lock the flange 18 within the groove 24. The handle 36 may be designed to extend at least partially through a mouth port 76 when in the unlocked position and be flush with or recessed within the mouth port 76 when in the locked position.

While the device 10 of the present inventive concept is operable to protect the user against impact to the user's head and neck, the device 10 could present a danger of injury to others, e.g., opponents when used during a sporting event, if the user uses the device 10 to "spear" impact them. While steps should be taken to modify rules of the sporting event to penalize such action, it is beneficial to provide a means of yielding within the collar 20 to dissipate or absorb the force of such impacts. For this purpose, the collar 20 includes a compression ring 39. The compression ring 39 includes a spring loaded channel and flange. The compression ring 39 is located around a perimeter of the base of the collar 20 and biases the collar 20 away from a remainder portion of the second component 14. The compression ring 39 is operable to allow the collar 20 to compress approximately 1 inch toward the portion of the remainder portion of the second component 14 when a compression force is applied to a portion, e.g., a top, of the collar 20.

It is foreseen that the flange 18 could be formed on the second component 14 and the receiver 22 could be formed on the first component 12 without deviating from the scope of the present inventive concept.

The second component 14 includes an outermost surface 40 that is at least partially contoured to a body of the user, e.g., a torso and shoulders. For example, a chest or front plate 41 of the second component 14 includes contoured portions 42 that are sized and shaped to correspond to a chest of the user, while a back plate 43 of the second component 14 is curved to correspond to a back of the user. The second component 14 includes a pair of openings 44 on either side of the second component 14 that are each operable to surround an uppermost portion of a shoulder of the user so that a portion of the shoulder and an arm of the user can extend from the second component 14 of the device 10. In this manner, the second component 14 is operable to allow an unimpaired full range movement of the arms of the user.

Each of the openings 44 include a body harness or fastener 46 secured at opposing ends 48, 50 of the second component 14. In the exemplary embodiment, the fastener 46 is a strap or belt and a buckle with the belt secured to the end 48 and the buckle secured to the end 50, but it is foreseen that another type of securing mechanism may be used without deviating from the scope of the present inventive concept. The fasteners 46 are operable to allow ends 48, 50 of the openings 44 to be selectively expanded away from each other and contracted toward each other by the user, e.g., when the user is taking the device 10 on or off, and to be secured together, e.g., during use of the device 10. The fasteners 46 are operable to be secured at one of a plurality of points, thereby allowing the ends 48, 50 to be secured at various distances with respect to each other. In this manner, the fasteners 46 allow the device 10 to accommodate various user body types.

The second component 14 houses a third component 60, i.e., an inflatable restraining system, positioned on one or more interior surfaces 62 of the collar 20. The third component 60 includes at least one compression pad or inflatable component 64 that is operable to be inflated by introducing air into a bladder 66 of the inflatable component 64 via a recessed valve 68 located on a side of the collar 20. The valve 68 is operable to be selectively opened and closed by the user, and is in communication with the bladder 66 to enable inflation and deflation of the bladder 66. The valve 68 is accessible via an access port 70 that extends through the collar 20 of the second component 14.

In the exemplary embodiment, the third component 60 is sized and shaped to encompass a neck and a portion of the head of the user, i.e., donut shaped. The third component 60 is operable to receive air into the bladder 66 and expand to snugly fit around the neck and the portion of the head of the user. The third component 60 includes an indent 72 sized and shaped to receive a chin of the user, and an opening 74 at the front that is positioned to align with the mouth port 76 at a front of the collar 20. The opening 74 and the mouth port 76 provide access to a mouth of the user.

The second component 14 also includes a plurality of pads 80 operable to diffuse and distribute force received on the device 10 from an impact. Each of the plurality of pads 80 are secured to an interior surface 82 of the second component 14 so that the interior surface 82 is substantially lined by the pads 80 and the interior surface 82 is spaced from the user by the pads 80. In the exemplary embodiment, the pads 80 are made of foam. It is foreseen, however, that the pads 80 may be made of rubber or the like without deviating from the scope of the present inventive concept.

The handle 36 also can be used as a mouthpiece ring 90 given its location on a side of the collar 20 and accessibility via the mouth port 76. The ring 90 is operable to provide a connecting point for a mouthpiece guard.

In this manner, the second component 14 is operable to function as a body harness, stabilizes and secures the mounting collar 20 to the body of the user, and allows the transference of force from impact on the first component 12 to the body of the user. The second component 14 is sized and shaped to allow traditional football shoulder pads to be fastened to the second component 14. In the exemplary embodiment, the second component 14 is made of high impact resistant plastic, which may be opaque or color infused. It is foreseen that the second component 14 may be made of another material such as, but not limited to polycarbonate, a carbon fiber material, or the like without deviating from the scope of the present inventive concept.

To use the device 10, the user disconnects the fasteners 46 and expands the openings 44. Then, wearing a tight, form-fitting t-shirt or the like, or no clothing, the user extends his/her head through a central hole 86 formed in part by the plates 41, 43 in the second component 14, through the collar 20, and into the first component 12 until the shoulders of the user abut shoulder portions 88 of the second component 14. When worn, the collar 20 encompasses the neck and lower head portion of the user and the circumferential receiver 22 of the collar 20 transcribing an imaginary line from below the nose to roughly the rear base of the skull of the user. Then, the user contracts the openings 44 via the fastener 46 to one of the plurality of positions provided by the fastener until the pads 80 abut the chest and back of the user or the t-shirt of the user. Then, the valve 68 is opened and air is introduced into the bladder 66 of the inflatable component 64 until the inflatable component abuts the neck and head of the user, at which point the valve 68 is closed to lock or trap the air in the bladder 66. In this manner, the third component 60 is tightly fitted around the neck and lower head portion of the user, and provides a shock absorber and prevents any contact between the head of the user and the collar 20 and the first component 12.

Figure 6B:
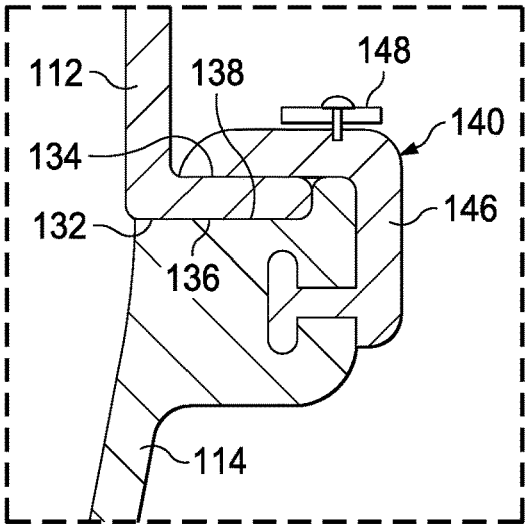
FIG. 6B is a magnified side view of a retainer ring of the device of FIG. 6A.
Figure 6A:
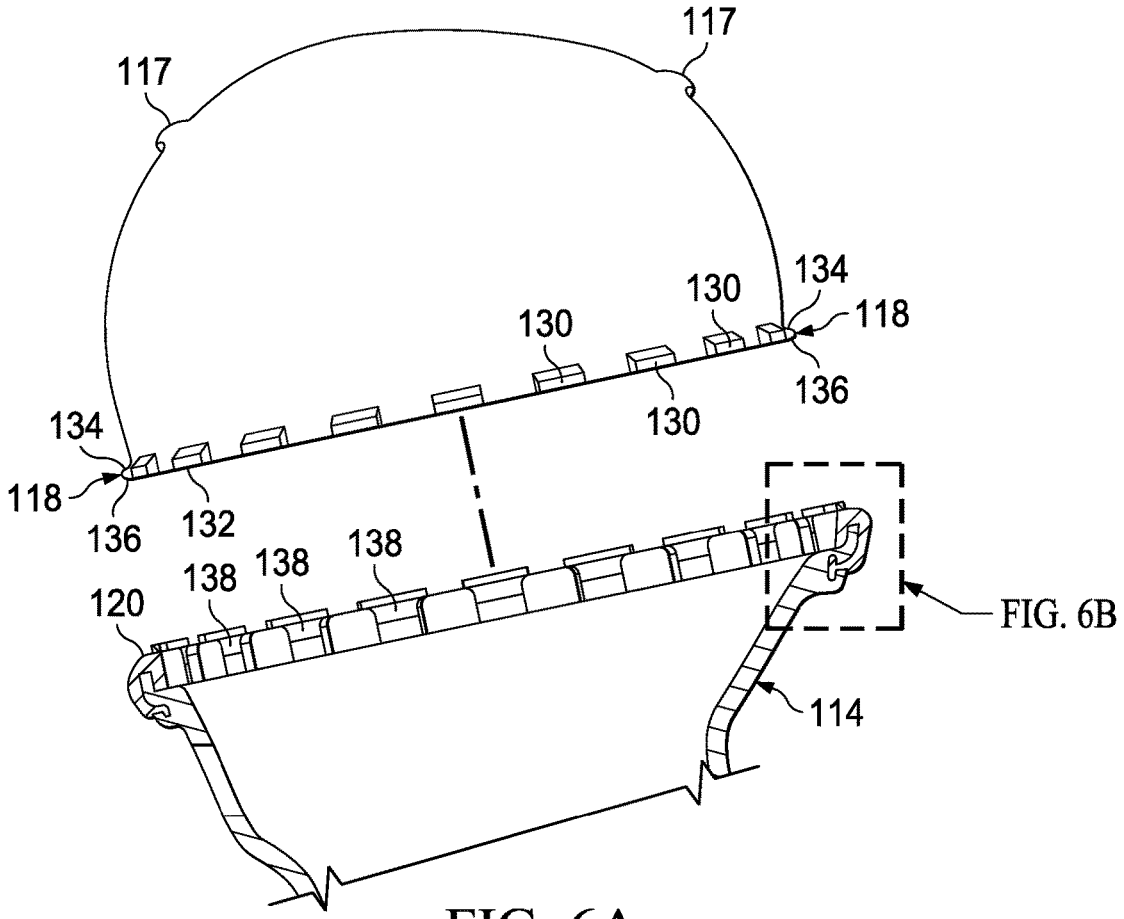
FIG. 6A is an exploded side view of another embodiment of the device of FIG. 1 with a first component removed from a second component and the second component in cross section.
Figure 6C:
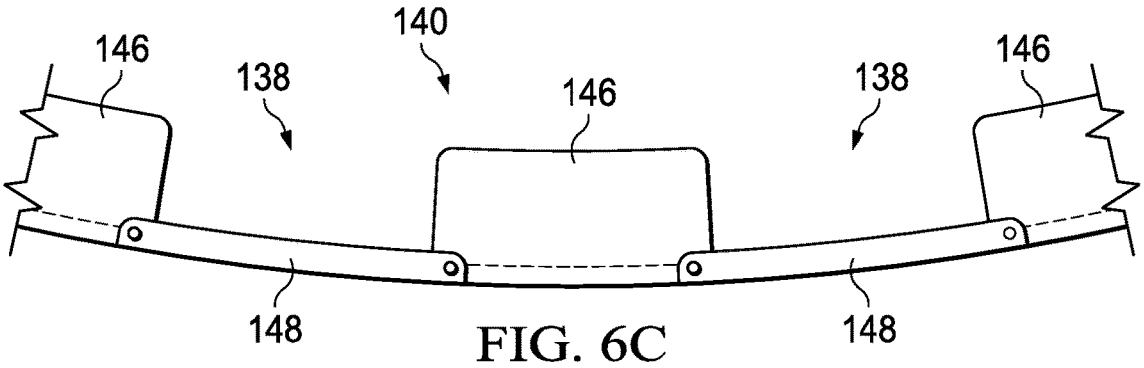
FIG. 6C is a magnified top plan side view of the retainer ring of the device of FIG. 6A.

As mentioned, the first component 12 may be secured to the second component 14 via a number of various engagements. For instance, in an alternative embodiment, as illustrated by FIGS. 6A-6C, a first component 112, with vent holes 117, is secured to the second component 114 via only vertical nesting without rotating the first component 112. In this embodiment, a flange 118 of the first component 112 includes a plurality of extensions 130 that extend horizontally from a bottom surface 132 of the first component 112 to the define an upwardly-facing abutment surface 134 and a downwardly-facing abutment surface 136. In this embodiment, the extensions 130 are spaced approximately 2 inches apart, but it is foreseen that the extensions 130 could be otherwise spaced without deviating from the scope of the present inventive concept. For instance, it is foreseen that the extensions 130 may be shorter or longer, e.g., be 1.75 to 2.25 inches long, and/or be variably sized without deviating from the scope of the present inventive concept.

To secure the first component 112 to the second component 114, the first component 112 is vertically placed onto the second component 114 so that each of the extensions 130 extends into one of a plurality of openings 138 in a rotatable ring 140 with each of the downwardly-facing abutment surfaces 136 abutting a top of the collar 120. The ring 140 is secured to the collar 120 via corresponding ridges 142 and grooves 144 on each of the collar 120 and the ring 140. In this embodiment, the ring 140 forms a "T" shaped portion that extends into a corresponding "T" shaped portion of the collar 120 of the second component 114. It is foreseen, however, that the ring 140 could have an "L" shaped portion operable to extend into a corresponding "L" shaped portion of the collar 120 of the second component 114 or other correspondingly-shaped portions without deviating from the scope of the present inventive concept. In this manner, the ring 140 is rotatably secured to the collar 120 of the second component 114. The ring 140 includes tabs 146 spaced from each other by spacer bars 148. After the first component 112 has been placed on the collar 120, the ring 140 is rotated so that each of the tabs 146 extends over one of the extensions 130 to abut the upwardly-facing abutment surface 134 and at least partially conceal each of the extensions 130. In this manner, the components 112, 114 are secured together via a friction-fit engagement.

Figure 7A:
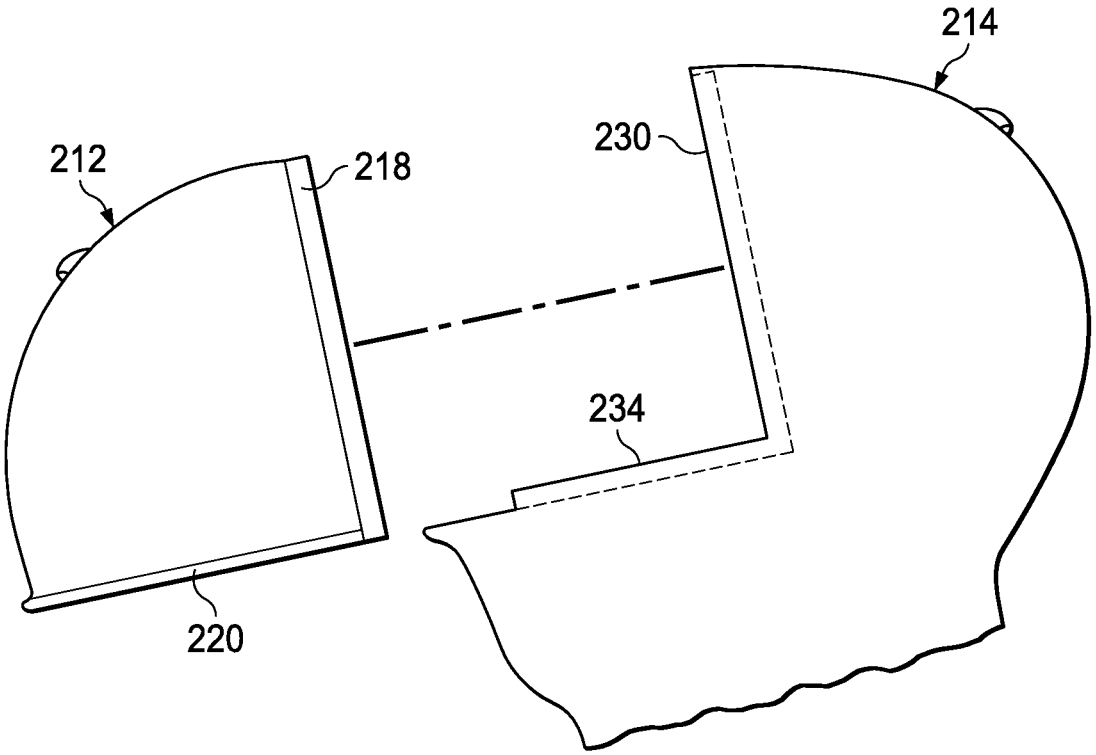
FIG. 7A is an exploded side view of another embodiment of the device of FIG. 1 with a first component removed from a second component.
Figure 7B:
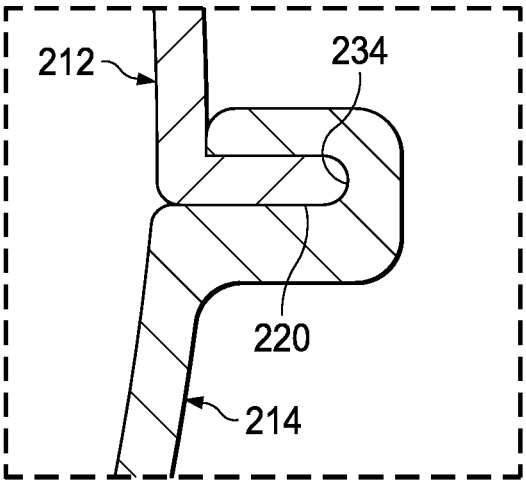
FIG. 7B is a magnified front view of the device of FIG. 7A with the first component secured to the second component and the first and second components in cross section.

Turning to FIGS. 7A and 7B, a first component 212 is secured to the second component 214 via only horizontal nesting without rotating the first component 212, the second component 214, or any portion thereof. The first component 212 is shaped as a quarter dome as opposed to the semi-spherical dome of the first component 12. An uppermost portion of the second component 214 is also shaped as a quarter dome that, in combination with the first component 212, collaboratively form a semi-spherical dome. In this embodiment, a vertical flange 218 and a horizontal flange 220 of the first component 212 is sized and shaped to be slidably received within vertical slot 230 and horizontal slot 234, respectively. In this manner, the components 112, 114 are secured together via a friction-fit engagement.

In another embodiment, the first component 12 may include a male thread and the second component may include a female thread that is sized and shaped to correspond to the male thread. The components 12, 14 may be secured together by (i) nesting the first component 12 into the second component 14 and (ii) rotating the first component 12 so the threads engage each other. In another embodiment, the first component 12 may have a portion that is sized and shaped to be slidably received into a groove a portion of include a male thread and the second component may include a female thread. The components 12, 14 may be secured together by (i) nesting the first component 12 into the second component 14 and (ii) rotating the first component 12 so the threads engage each other.

Accordingly, the device 10 of the present inventive concept provides impact protection to the user of the device 10 by channeling force received from an impact during an activity of the user such as, but not limited to participating in sports, e.g., football, lacrosse, BMX, NASCAR, and rally racing, or at a jobsite, e.g., construction, thereby decreasing the likelihood the user will be injured or killed by the impact.

Having now described the features, discoveries and principles of the present inventive concept, the manner in which the present inventive concept is constructed and used, the characteristics of the construction, and advantageous, new and useful results obtained; the new and useful structures, devices, tools, elements, arrangements, parts and combinations, are set forth in the appended claims.

It is also to be understood that the following claims are intended to cover all of the generic and specific features of the present inventive concept herein described, and all statements of the scope of the present inventive concept which, as a matter of language, might be said to fall there between.

What is claimed is:

1. A protective device operable to transfer force from a first portion of a user to a second portion of the user, the device comprising:

a first component operable to encapsulate the first portion of the user, at least a portion of the first component being at least partially transparent to permit the user to view through the portion of the first component;

a second component operable to secure the first component to the second portion of the user, the second component including at least one mounting collar secured to the remainder of the second component via a spring-loaded compression ring so that the at least one mounting collar is biased away from the remainder of the second component; and a third component secured to the second component, the third component operable to be at least partially inflated by the user to cause the third component to be fitted to the user and limit movement of the user relative to the second component while using the protective device.

2. The device of claim 1, wherein, the first component is at least partially dome-shaped.

3. The device of claim 1, wherein, the second component is operable to function as a body harness.

4. The device of claim 1, further comprising:

a circulation system operable to (i) permit gas to enter and/or exit the first component, and (ii) maintain a degree of visibility through the portion of the first component.

5. The device of claim 4, wherein, the circulation system includes at least one vent in the first component.

6. The device of claim 1, wherein the third component includes at least one interior compression pad having an inflatable bladder.

7. The device of claim 6, wherein the second component includes an access port to provide access through the second component to inflate the inflatable bladder.

8. The device of claim 7, further comprising:

at least one inflation valve accessible via the access port on the second component, the at least one inflation valve in communication with the inflatable bladder.

9. The device of claim 8, wherein, the at least one inflation valve is recessed relative to an outermost surface of the second component.

10. The device of claim 1, further comprising:

at least one front opening in the second component.

11. The device of claim 1, further comprising:

at least one locking mechanism operable to secure the first component to the second component.

12. The device of claim 1, further comprising:

a mouthpiece ring operable to secure a mouth guard to the device.

13. The device of claim 1, further comprising:

at least one fastener on the second component.

14. The device of claim 1, further comprising:

at least one shoulder pad and/or chest plate on the second component.

15. The device of claim 1, wherein the first component is operable to be secured to the second component by insertion of the first component into the second component.

16. The device of claim 1, wherein the first portion of the user is a head of the user, and the second portion of the user is a body of the user.

17. The device of claim 1, the compression ring includes a spring-loaded channel.

18. A protective device operable to transfer force from a first portion of a user to a second portion of the user, the device comprising:

a first component operable to encapsulate the first portion of the user, at least a portion of the first component being at least partially transparent to permit the user to view through the portion of the first component;

a second component operable to secure the first component to the second portion of the user, the second component including at least one mounting collar secured to the remainder of the second component via a spring-loaded compression ring so that the at least one mounting collar is biased away from the remainder of the second component; and a third component secured at least partially within the second component, the third component operable to limit movement of the user relative to the second component.

* * * * *